US009545716B2

(12) United States Patent
Hsieh

(10) Patent No.: US 9,545,716 B2
(45) Date of Patent: Jan. 17, 2017

(54) END PIECE OF A TOOL SUSPENSION RACK

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 7 days.

(21) Appl. No.: 14/661,342

(22) Filed: Mar. 18, 2015

(65) Prior Publication Data

US 2016/0271788 A1 Sep. 22, 2016

(51) Int. Cl.
*B25H 3/04* (2006.01)

(52) U.S. Cl.
CPC ..... *B25H 3/04* (2013.01)

(58) Field of Classification Search
CPC ..... B25H 3/04; A47B 96/067
USPC ..... 211/69, 70.6; 206/378
See application file for complete search history.

(56) References Cited

U.S. PATENT DOCUMENTS 4,320,935 A * 3/1982 Nagelkirk ..... A47B 95/008 108/152
4,457,436 A * 7/1984 Kelley ..... A47B 95/008 211/88.01
4,771,897 A * 9/1988 Ho ..... A47G 29/10 211/85.9
5,645,177 A * 7/1997 Lin ..... B25H 3/04 206/378
5,740,927 A * 4/1998 Yemini ..... A47B 96/067 211/66
6,152,312 A * 11/2000 Nava ..... A47B 61/003 211/94.01
6,431,373 B1 * 8/2002 Blick ..... B25H 3/003 206/378
6,435,357 B1 * 8/2002 Lee ..... A47F 5/0838 211/70.6
6,626,402 B1 * 9/2003 Kaminstein ..... A46B 17/02 211/70.6
6,637,605 B2 * 10/2003 Ernst ..... B25H 3/003 206/378
6,698,603 B2 * 3/2004 Lawson ..... A47F 5/0846 211/94.01
7,028,854 B1 * 4/2006 Londrico ..... A47B 65/00 211/120
7,137,515 B1 * 11/2006 Lawson ..... A47G 25/746 211/85.3
7,798,339 B2 * 9/2010 Brooks ..... G11B 33/02 211/103
8,066,130 B2 * 11/2011 Shaha ..... A47B 96/067 211/106.01
9,186,790 B1 * 11/2015 Kao ..... B25H 3/06
9,247,832 B2 * 2/2016 Chang ..... A47F 5/0823
9,375,836 B2 * 6/2016 Su ..... B25H 3/04
2006/0234846 A1 * 10/2006 Tucker ..... B25H 3/04 483/26

(Continued)

*Primary Examiner* — Stanton L Krycinski
(74) *Attorney, Agent, or Firm* — Egbert Law Offices, PLLC

(57) ABSTRACT

An end piece of a tool suspension rack is mounted onto a distal end of a metal rack of the tool suspension rack. The metal rack has at least one slide structure formed thereon for slidably multiple tool holders, wherein at least one distal end of the metal rack has an end piece mounted thereon. The end piece has a groove structure defined therein for allowing the tool holder passing through the end piece such that the tool holders is slidably mounted on the metal rack. The groove structure has a curved protrusion formed on an inner periphery thereof to prevent the tool holders, which are slidably mounted on the metal rack, from accidently detaching from the metal rack.

3 Claims, 5 Drawing Sheets

(56) References Cited

U.S. PATENT DOCUMENTS

| | | | | |
|---|---|---|---|---|
| 2010/0219144 | A1* | 9/2010 | Salmon | A47B 96/067 211/94.01 |
| 2011/0174752 | A1* | 7/2011 | Liao | A47F 5/0838 211/70.6 |
| 2014/0209780 | A1* | 7/2014 | Chang | A47F 5/0823 248/551 |
| 2015/0151428 | A1* | 6/2015 | Su | B25B 13/56 403/361 |
| 2015/0336262 | A1* | 11/2015 | Kao | B25H 3/06 206/378 |

* cited by examiner

END PIECE OF A TOOL SUSPENSION RACK

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an end piece, and more particularly to an end piece of a tool suspension rack.

2. Description of Related Art Including Information Disclosed Under 37 CFR 1.97 and 37 CFR 1.98.

For user's various operating requirements and hand tools with different sizes or standards, the slide structure on the tool suspension rack is uniformed for tool holders with different types for various hand tools, such as sockets, wrenches and series of allen wrenches. Consequently, the end piece, mounted on a distal end of a metal rack of the tool suspension rack often needs to be detached from or mounted onto the distal end of the metal rack for changing the tool holders for hand tools with different sizes/standards. As is well known, the end piece usually is made of plastic and has a hardness much less than that of the metal rack. As a result, the end piece is quickly worn out and the connection between the end piece and the metal rack is gradually weakened such that the end piece gradually loses its original function of limiting the tool holders and preventing the tool holders from being accidently detached from the metal rack.

The present invention has arisen to mitigate and/or obviate the disadvantages of the conventional end piece of a tool suspension rack.

BRIEF SUMMARY OF THE INVENTION

The main objective of the present invention is to provide an improved end piece of a tool suspension rack, which can easily mount the tool holder with being detaching from the tool suspension rack.

To achieve the objective, the end piece in accordance with the present invention is mounted onto a distal end of a metal rack of the tool suspension rack. The metal rack has at least one slide structure formed thereon for slidably multiple tool holders, wherein at least one distal end of the metal rack has an end piece mounted thereon. The end piece has a groove structure defined therein for allowing the tool holder passing through the end piece such that the tool holders is slidably mounted on the metal rack. The groove structure has a curved protrusion formed on an inner periphery thereof to prevent the tool holders, which are slidably mounted on the metal rack, from accidently detaching from the metal rack.

Further benefits and advantages of the present invention will become apparent after a careful reading of the detailed description with appropriate reference to the accompanying drawings.

DETAILED DESCRIPTION OF THE INVENTION

Figure 1:
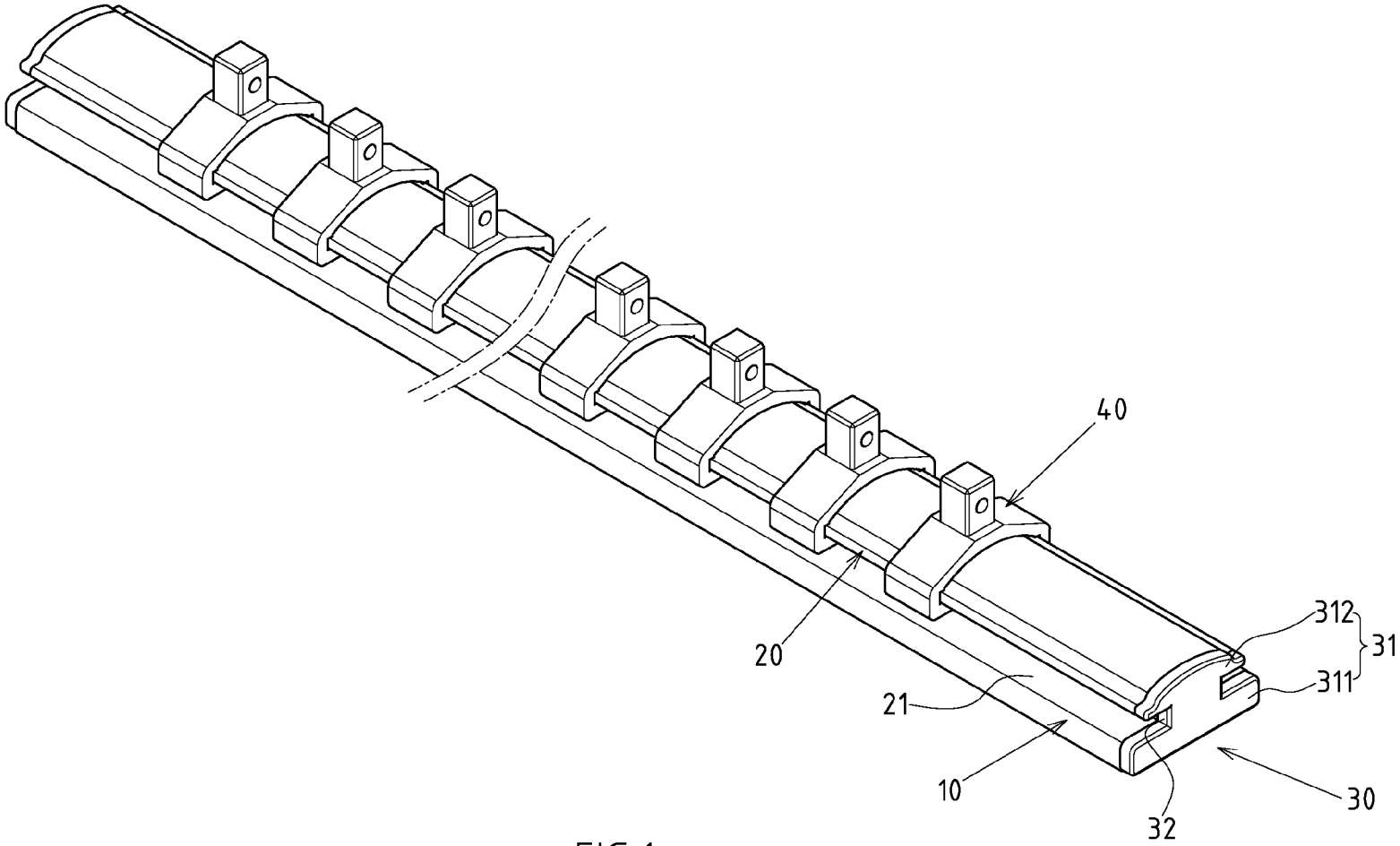
FIG. 1 is a perspective schematic view of an end piece in accordance with the present invention, wherein the end piece is mounted onto a distal end of a metal rack.
Figure 2:
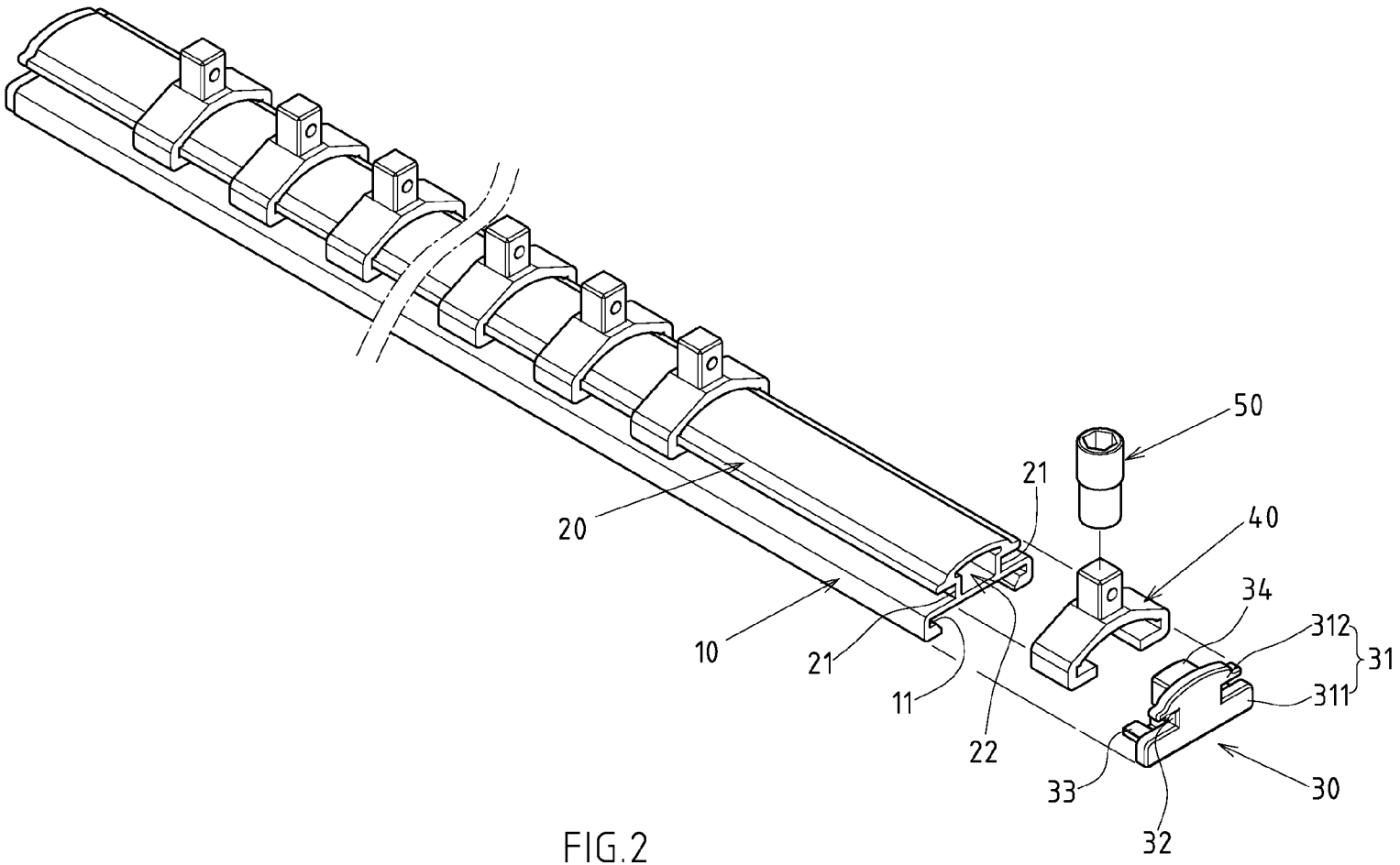
FIG. 2 is a partial exploded perspective view of FIG. 1.
Figure 3:
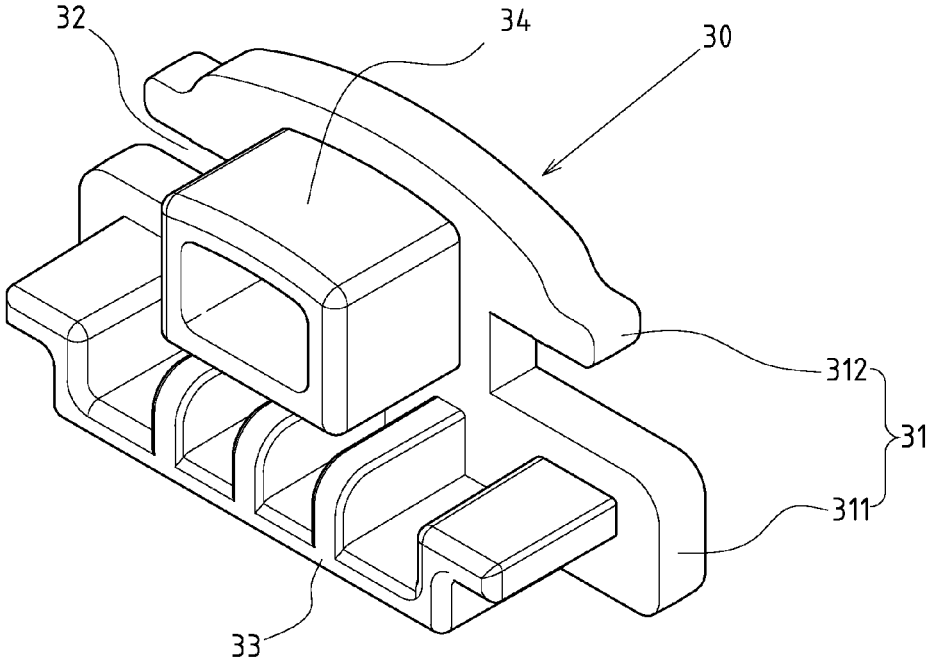
FIG. 3 is a perspective view of the end piece in accordance with the present invention.
Figure 4:
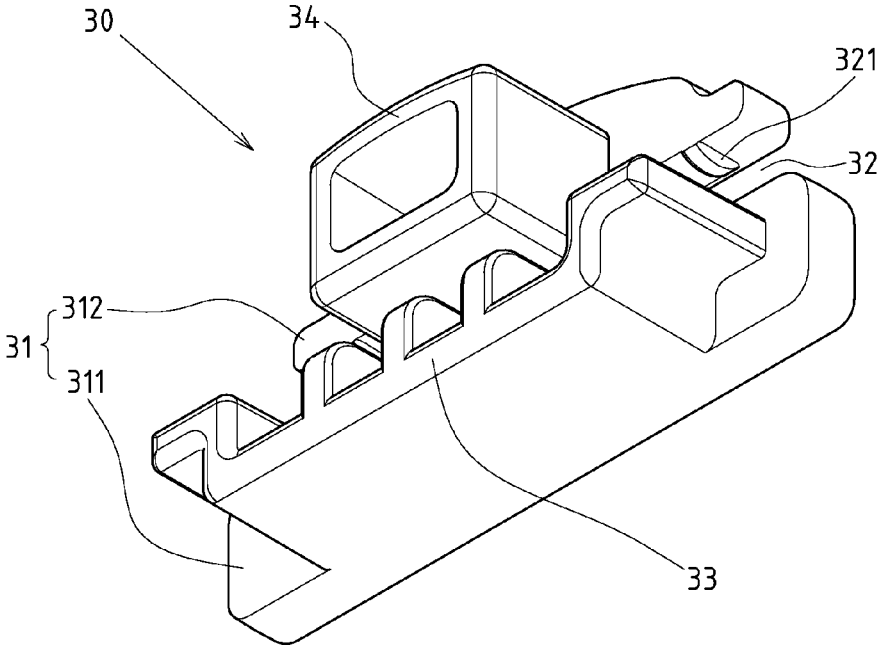
FIG. 4 is a another perspective view of the end piece in accordance with the present invention.

As is well known, a tool suspension rack usually includes an elongated metal rack having at least one slide structure formed thereon for slidably multiple tool holders, wherein at least one distal end of the metal rack has an end piece mounted thereon. The end piece has a groove structure defined therein for allowing the tool holder passing through the end piece such that the tool holders is slidably mounted on the metal rack. The groove structure has a curved protrusion formed on an inner periphery thereof to prevent the tool holders, which are slidably mounted on the metal rack, from accidently detaching from the metal rack. The two preferred embodiments of the end piece in accordance with the present invention are described in detail and the elements id numbered, hereinafter.

Referring to the drawings and initially to FIGS. 1-4, the tool suspension rack includes an elongated metal rack 10 and at least one slide structure 20 is formed on one side of the metal rack 10 for slidably mounting multiple tool holders 40. In the preferred embodiment of the present invention, the metal rack 10 has only one slide structure 20 formed on a top thereof and a T-shaped groove 11 is longitudinally defined in a bottom of the metal rack 10, wherein the slide structure 20 has a T-shaped cross-section, wherein two grooves 21 is defined in two opposite sides of the slide structure 20. The slide structure 20 has a through hole 22 longitudinally defined therein.

The end piece 30 in accordance with the present invention is adapted to be mounted to a distal end of the metal rack 10. The end piece 30 includes an I-shaped plate 31 divided into a horizontal portion 311 and a T-shaped portion 312, wherein the horizontal portion 311 and the T-shaped portion respectively correspond to the cross-sections of the metal rack 10 and the slide structure 20. Two indentations 32 are respectively defined in two opposite sided of the T-shaped portion 312, wherein each indentation 32 communicates with a corresponding one of the two grooves 21 in the slide structure 20 to form two slidable routes for slidably mounting the tool holders 40 onto the metal rack 10 with the slide structure 20. Each indentation 32 is peripherally formed with a curved protrusion 321 stretching along the corresponding one of the two slidable routes. In the preferred embodiment, the curved protrusion 321 is formed on a top of each of the two indentations 32. A first tenon 33 and a second tenon 34 respectively and vertically extends from the horizontal portion 311 and the T-shaped portion 312, wherein the first tenon 33 and the second tenon 34 are respectively inserted into the T-shaped groove 11 and the through hole 22 in the slide structure 20 to prevent the end piece 30 from accidently detaching from the metal rack 10, and the second tenon 34 is hollow for saving forming material.

When mounting the tool holders 40 onto the metal rack 10 with the end piece 30 in accordance with the present invention, the at least one end piece 30 is firstly mounted on at least one distal end of the metal rack 10 and the tool holders 40 is individually slidably mounted onto the slide structure 20 for collecting hand tools 50 after moved over the curved protrusions 321. However, the tool holder 40 cannot be freely moved on the slide structure 20 due to the friction force between the tool holder 40 and the slide structure 20 such that the user can adjust the spacing between two adjacent tool holders 40 for mounting more tool holders 40 on the metal rack 10 to collecting more hand tools 50. The curved protrusions 321 prevent the tool holders 40 from detaching from the metal rack 10 when being overly moved by the operator. When change the tool holders 40 for the hand tools 50 with different types, the tool holder 40 is moved toward the end piece 30 and the curved protrusion 321 provides a damping to the tool holder 40. Then, the operator only needs to further force the tool holder 40 and the tool holder 40 passes through the indentations 32 when the force on the tool holder 40 is great than the friction force between the tool holder 40 and the end piece 30. As described above, the end piece 30 does not need to be detached from the metal rack 10 when originally mounting the tool holders 40 or changing the tool holders 40 for the hand tools 50 with different types.

In addition, for enhancing the connection between the metal rack 10 and the end piece 30, the first tenon 33 and the second tenon 34 can be glued on the metal rack 10 to further prevent the end piece 30 from detaching from the metal rack 10 when removing the tool holder 40. For the manufacturing cost and conventional manufacturing skill, the end piece 30 in accordance with the present invention is made of plastic. However, the end piece 30 does not need to be detached from the metal rack 10 when mounting and removing the tool holder 40 from the metal rack 10. As result, the end piece 30 in accordance with the present invention is not worn out and has a longer use life than the use life of the conventional end piece of a tool suspension rack.

Figure 5:
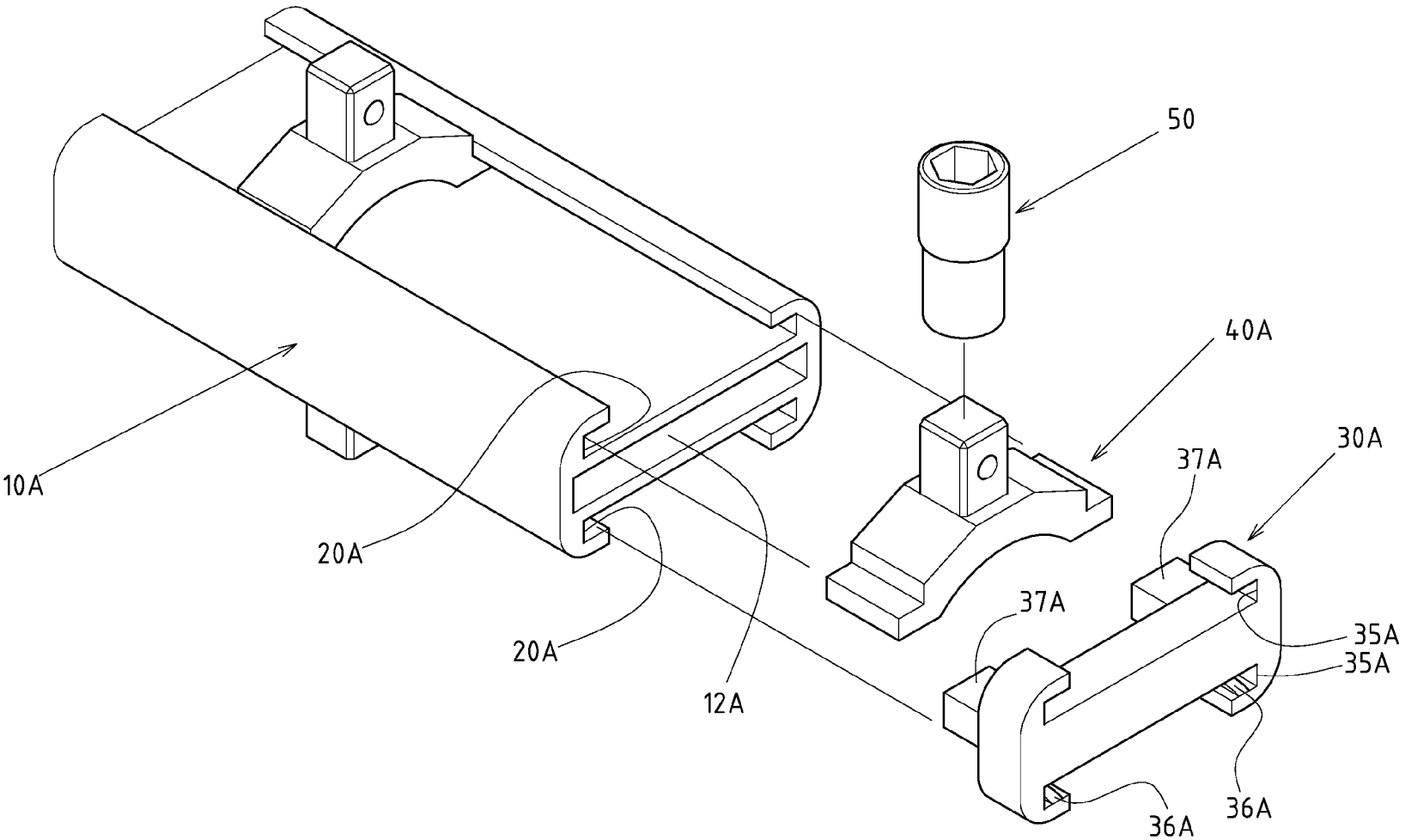
FIG. 5 is an exploded perspective schematic view of a second embodiment of the end piece in accordance with the present invention.
Figure 6:
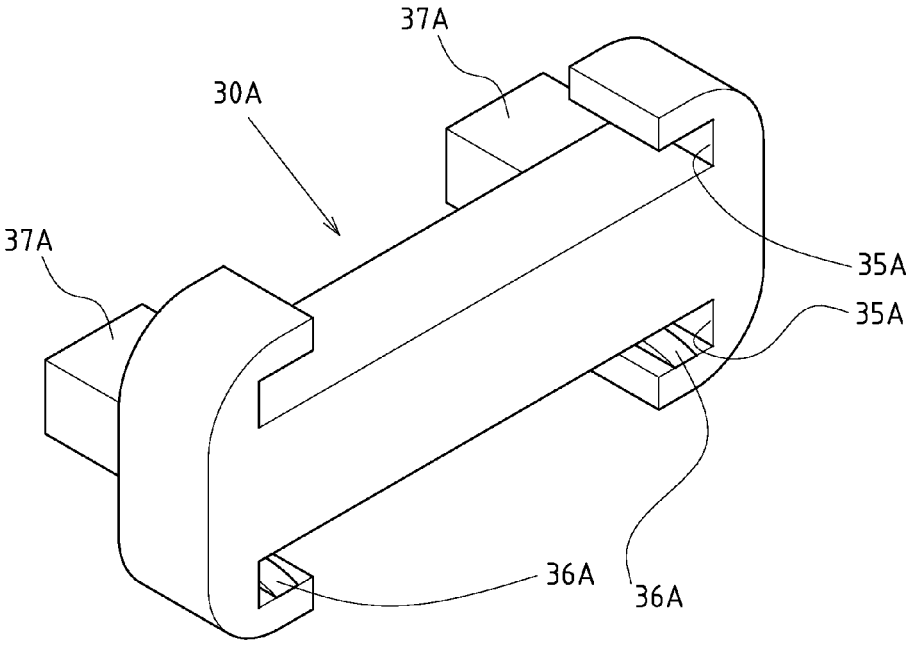
FIG. 6 is a perspective view of the second embodiment of the end piece in accordance with the present invention.
Figure 7:
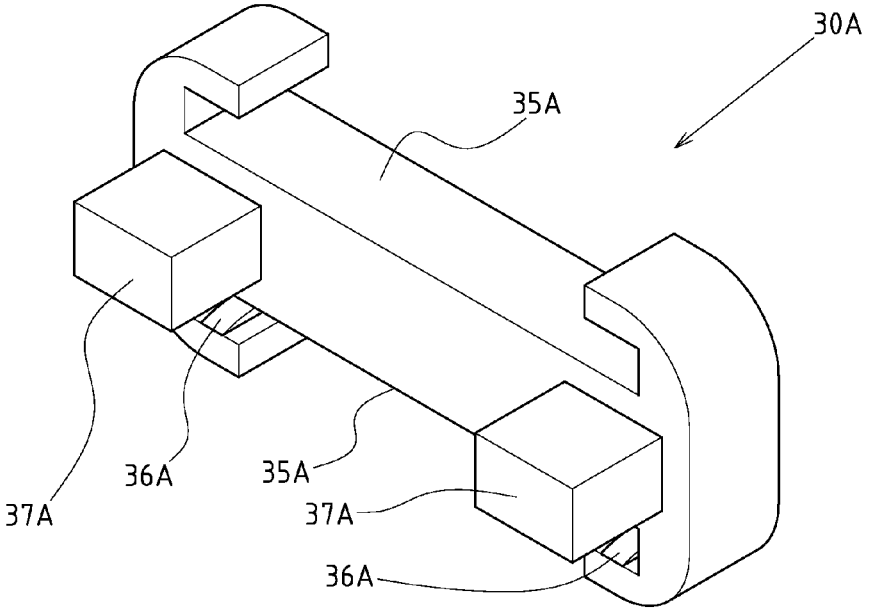
FIG. 7 is a another perspective view of the second embodiment of the end piece in accordance with the present invention.

With reference to FIGS. 5 and 6 that show a second embodiment of the present invention, in this embodiment, the metal rack 10A includes at least one slide structure 20A longitudinally defined in one face thereof for slidably mounting multiple tool holders 40A. In the preferred embodiment, the metal rack 10A has two slide structures 20A respectively defined in two opposite faces thereof, wherein the two slide structures 20A are T-shaped grooves and a tunnel 12A is defined in the metal rack 10A between the two slide structures 20A. The end piece 30A has two T-shaped grooves 35A respectively defined in two opposite sides thereof. Each T-shaped groove 35A communicates with a corresponding one of the two slide structures 20A for allowing the tool holder 40A passing through the end piece 30A, and has a curved protrusion 36A peripherally formed thereon. The shape and the function of the curved protrusion 36A of the second embodiment are that same as that of the curved protrusion 321 of the first embodiment, hereinbefore. The end piece 30 includes at least one tenon 37A vertically extending therefrom and inserted into the tunnel 12A for holding the end piece 30A in place on the distal end of the metal rack 10A. In the preferred embodiment of the present invention, the end piece 30A has two tenons 37A extending therefrom for achieving the purpose of saving material.

As described above, the end piece 30/30A in accordance with the present invention has the advantages as follows:

1. The end piece in accordance with the present invention does need to be detached from the metal rack when mounting or removing the tool holders to maintain the connection between the end piece and the metal rack.
2. The end piece in accordance with the present invention and the tool holders are made of plastic such that the end piece is not quickly worn out and the use life of the end piece in accordance with the present invention is lengthened relative to that of the conventional end piece of a tool suspension rack.

Although the invention has been explained in relation to its preferred embodiment, it is to be understood that many other possible modifications and variations can be made without departing from the spirit and scope of the invention as hereinafter claimed.

I claim:

1. A tool suspension rack apparatus comprising:

an elongated metal rack having at least one slide structure formed thereon, said at least one slide structure slidably receiving multiple tool holders; and an end piece secured on a distal end of said elongated metal rack, said end piece having at least one groove structure defined therein, said at least one groove structure allowing the tool holders to pass therethrough, said at least one groove structure having a curved protrusion formed on an inner periphery thereof so as to prevent the tool holders from accidentally detaching from said elongated metal rack, said at least one slide structure having a pair of grooves defined in opposite sides thereof, said end piece having two indentations respectively defined in opposite sides of a T-shaped portion, each of said two indentations communicating with a corresponding groove of said pair of grooves of said at least one slide structure so as to slidably mount the multiple tool holders onto said elongated metal rack with said at least one slide structure, said curved protrusion peripherally formed on each of said two indentations and extending along each of said pair of grooves of said at least one slide structure.

2. The tool suspension rack apparatus of claim 1, said elongated metal rack having a T-shaped groove longitudinally defined in a bottom thereof, said at least one slide structure having a through hole longitudinally defined therein, said end piece having a first tenon and a second tenon respectively inserted into said T-shaped groove and said through hole so as to prevent said end piece from accidentally detaching from said elongated metal rack.

3. The tool suspension rack apparatus of claim 2, said first tenon and said second tenon being glued on said elongated metal rack so as to prevent said end piece from detaching from said elongated metal rack when removing one of the multiple tool holders.

* * * * *